United States Patent [19]

Kammann et al.

[11] 4,245,554

[45] Jan. 20, 1981

[54] SCREEN PRINTING PROCESS AND MACHINE

[75] Inventors: Wilfried Kammann, Bünde; Gerhard Tiemann, Löhne, both of Fed. Rep. of Germany

[73] Assignee: Werner Kammann Maschinenfabrik GmbH, Bunde, Fed. Rep. of Germany

[21] Appl. No.: 938,642

[22] Filed: Aug. 31, 1978

[30] Foreign Application Priority Data

Mar. 11, 1978 [DE] Fed. Rep. of Germany ..... 2810690

[51] Int. Cl.[3] ..... B41L 13/18

[52] U.S. Cl. ..... 101/124; 101/123; 101/126

[58] Field of Search ..... 101/48-51, 101/112, 116, 115, 114, 123, 124, 126, 129, 228, 253-260, 282, 286

[56] References Cited

U.S. PATENT DOCUMENTS

| | | | |
|---|---|---|---|
| 3,229,627 | 1/1966 | Pollitt | 101/115 |
| 3,945,317 | 3/1976 | Brasa | 101/124 |
| 4,063,503 | 12/1977 | Ichinose | 101/123 |

*Primary Examiner*—Edgar S. Burr
*Assistant Examiner*—A. Heinz
*Attorney, Agent, or Firm*—Howson and Howson

[57] ABSTRACT

In a screen printing process and machine for stepwise printing a succession of images, the screen printing stencil is moved along with the material during the printing operation, while the material is supported by a rotatable backing roller against the force applied to the material by the screen and a doctor blade disposed opposite the backing roller. During the printing operation the material is rolled against the stencil by the backing roller which together with the doctor may be moved in the opposite direction to the stencil. The direction of movement of the backing roller and an upstream guide roller, relative to the direction of movement of the stencil, is such as to promote separation of the material after printing from the stencil.

28 Claims, 12 Drawing Figures

63
4 3 2 1 0
81
68
83
25
16
R
13
23
18
17
X
A B C D
60
62
67
73
79
Y
Z 13
16
75
23
77
4 3 2 1 0
17
18
25
A B C D 13
62
77
60
63
69
4 3 2 1 0
23
17
18

13
16
77
23
4 3 2 1 0
73
17
18
25
68

FIG. 5
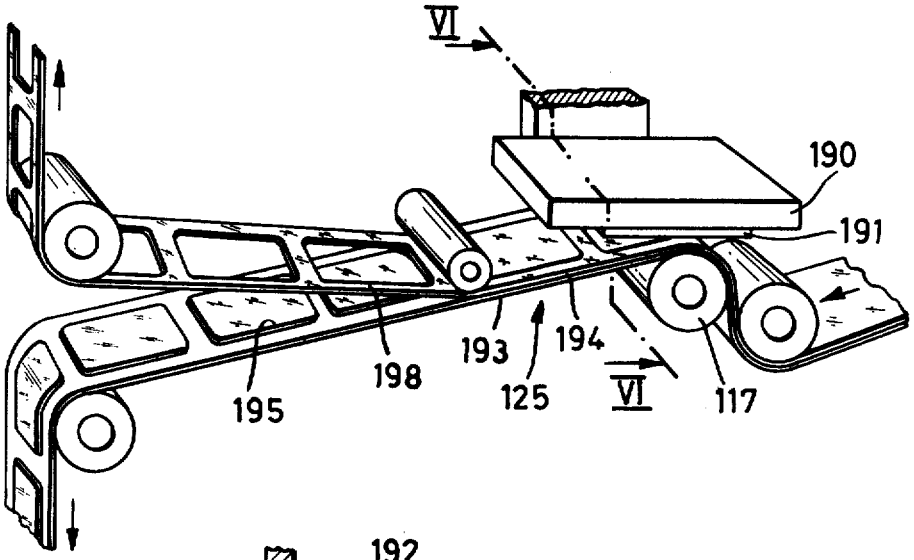
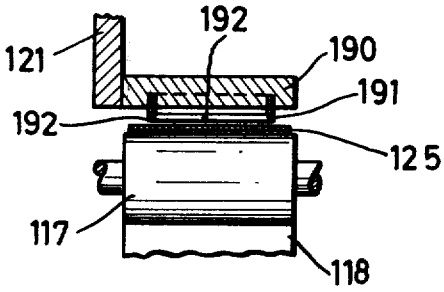
FIG. 6

SCREEN PRINTING PROCESS AND MACHINE

BACKGROUND OF THE INVENTION

In one form of the known screen printing method, for the stepwise printing of successive patterns or images on a web of material, the web is carried on a moving support, below the screen printing stencil with its associated squeegee or doctor. The stencil is lowered on to the material for the printing operation during which the stencil is moved in the direction of movement of the web, from an initial starting position to a final or end position relative to the stationary doctor. While the stencil is moving in this way, the doctor presses print medium e.g. ink or dye through the stencil on to the web, whereafter the stencil and doctor are lifted from the web and are returned to their relative starting positions.

It will be appreciated that with this process there is the disadvantage that the material to be printed must be fed forward with a stepwise movement with the stencil so that, irrespective of whether the patterns or images to be printed are applied to the web, at spacings from each other or in direct succession, that is to say, without any space between each two consecutive images, only a relatively low throughput of print material can be achieved.

In another form of screen printing method, use is made of a stencil in the form of an endless moving belt driven synchronously with the web which is passed continuously through the printing mechanism. With this process and apparatus the images to be printed may be printed on the web without any spacing between each two consecutive images, and very high levels of material through-put can be achieved. However, for certain cases of printing, this process suffers from the disadvantage that the stencil belt provides virtually no possibility of adjustment as regards the distribution of the printed patterns or images on the web, that is to say, the pattern repeat length. This is because the length of the stencil belt is fixed by the distance between the two guide rollers or drums around which the stencil belt is passed. It will indeed rarely happen that, with a given pattern repeat length, that pattern repeat length or a multiple thereof is to be precisely disposed on the screen printing stencil, that is to say, without any residual sections or portions which are shorter than a pattern length. Theoretically it might be possible to adapt the length of the stencil belt to particular circumstances, as by corresponding adjustment of the distances between the rollers or cylinders around which the stencil belt passes, but this presupposes extremely complicated and thus expensive mechanisms for this purpose. Another disadvantage of this is that the production costs of a stencil belt of this kind are so high that such a stencil belt is only used when a very large number of items are to be printed. An example in this connection is the production of labels or tickets which are generally produced by first printing on a web of material and then separating the individual labels or tickets from the printed web. If a large issue of a given ticket or label is to be produced, it is quite possible to use the above-mentioned method, but if smaller numbers are to be issued, then the production costs per ticket or label are excessively high.

SUMMARY OF THE INVENTION

It is an object of the invention to provide a screen printing process and apparatus which do not suffer from the above-mentioned disadvantages.

A further object of the invention is to provide a screen printing process and apparatus which permit a high through-put of printed material, even when the material is to be printed with spaced pattern or images in a stepwise manner.

A still further object of the invention is to provide a printing apparatus which is simple in construction and which has printing mechanisms that can readily be adapted or adjusted to different repeat lengths of pattern or image to be printed.

Yet another object of the invention is to provide a printing machine which can print patterns or images on a web of material, with or without spacings between each two consecutive patterns or images as required.

A yet further object of the invention is to provide a printing process and apparatus in which the web of material after printing thereon can be readily separated from the screen printing stencil which operates in a stepwise manner.

These and other objects are achieved by the present invention which provides that the web of material which passes continuously through the printing machine is guided over a counter-pressure or backing roller which is disposed opposite the squeegee or doctor on the side of the stencil which is remote from the squeegee or doctor, the web being rolled against the screen by the roller during the printing operation. Operation is preferably such that the squeegee or doctor and the counter-pressure roller are displaced synchronously and in the opposite direction to the direction of movement of the web and the stencil, during the printing operation. This provides that the speed at which the pattern or image, herein referred to as the image, is printed on the web is greater than the speed of movement of the web itself so that, when the said relative speeds are suitably adjusted relative to each other, it is possible for the distances between each two consecutive images or patterns printed on the web to be varied as desired, and for such distances thus to be adjusted from a zero value when each two consecutive images are printed directly one after the other without any intermediate spacing or even in such a way that the adjacent end regions of each two consecutive images do in fact slightly overlap, if that is required, to any desired spacing between consecutive images or patterns.

In the process and apparatus of the invention, the portion of the web which is passing into the printing mechanism of the machine, and the portion of the web which is issuing from the printing mechanism after the printing operation, extend parallel to each other, at least over the length of the region over which the counter-pressure roller is displaced during the printing movement, and both extend downwardly at an acute angle relative to the substantially horizontally disposed stencil. At least during the printing movement, the printing mechanism, comprising stencil, squeegee or doctor, counter-pressure roller and possibly a web guide roller disposed upstream of the counter-pressure roller is moved parallel to the aforesaid portions of the web. This manner of performing the process is based on the consideration that, when printing material in web form, it is desirable for the web to be moved away from the stencil at an acute angle immediately after the print has been applied to the web, so that the stencil and the printed web are separated from each other as quickly as possible, rapid separation preventing any impairing of the quality of the print on the web. Moving the printed web portion away from the stencil and the counter-pressure roller at an angle as indicated above, does however result in a change in the speed of the web at the stencil, when the counter-pressure roller is displaced during the printing operation in the horizontal plane, so that the synchronisation, required for good printing, between the movement of the stencil on the one hand and the movement of the web on the other hand, would not be guaranteed. The invention takes account of this fact by the above-described mode of operation in which the movement of the counter-pressure roller and thus of the entire printing mechanism as defined above is in a direction parallel to the path of movement of the planar web, being the path which the web follows between guide members, generally in the form of rollers or cylinders which guide the web upstream and downstream of the printing mechanism. The angle at which the two aforesaid web portions extend is preferably from around 0° to 20° relative to the horizontal, i.e. relative to the horizontal stencil.

Apparatus according to the invention, as for carrying out the process as outlined above, comprises a screen printing stencil which is reciprocable with an adjustable stroke movement, and a squeegee or doctor for rolling print medium through the stencil on to the material to be printed. A support member is disposed at the side of the stencil remote from the squeegee or doctor, for supporting the web during printing, while the squeegee or doctor is rolling ink or dye through the stencil. The support is in the form of the rotatably mounted counter-pressure or backing roller. The squeegee or doctor and the counter-pressure roller may be arranged so as to be displaceable in the opposite direction to the direction of movement of the stencil, during the printing stroke movement of the mechanism. Generally this movement of the squeegee and counter-pressure roller will also be a reciprocating movement.

The squeegee and counter-pressure roller, and possibly the above-mentioned optional web guide roller disposed upstream of the counter-pressure roller, are advantageously carried by a common mounting which can be guided on guide means which extend parallel to the aforesaid portions of the web entering and leaving the printing mechanism and thus at an acute angle to the stencil.

It will generally be advantageous for the counter-pressure roller, and possibly also the above-mentioned web guide roller, to be driven, as otherwise the web of material would be required to transmit thereto the forces required for rotating the counter-pressure roller and the web guide roller. In addition, if these rollers are not driven as just mentioned, there might be slippage between the web of material on the one hand and the peripheral surfaces of the rollers on the other, and this could possibly impair the quality of the print. It is also possible for the rotary movement of the counter-pressure roller and/or the guide roller to be controlled in dependence on the speed at which such rollers are displaceable relative to the web of material.

The machine may also have at least two web drive and/or guide rollers, each arranged at a spacing from the printing mechanism; each such roller may be driven by a shaft on which it is mounted and which carries a gear wheel or cog. The counter-pressure roller and the above-mentioned web guide roller upstream thereof may similarly have drive gears, and all the said gears may be interconnected for the transmission of drive by way of a common flexible elongate transmission means such as a chain, which preferably extends parallel to the web in the region in which the transmission means moves in the same direction as the web.

The length of travel of the reciprocating movement of the stencil and/or the squeegee or doctor and the counter-pressure roller, and possibly the above-mentioned web guide roller disposed upstream of the counter-pressure roll, may be adjustable.

A central drive assembly may be provided for all the movable components of the apparatus, and the speed of movement of the web may be adapted to the speed of movement of the stencil by an adjustable transmission assembly which is interposed in the drive train transmitting drive to the web. It is furthermore also possible for the means for transmitting the drive to the mounting for the stencil and/or the mounting for the squeegee or doctor and the counter-pressure roller to be adjustable and/or interchangeable.

The printing apparatus may comprise a plurality of successive printing stations through which the web of material is passed in a single working operation. The number of printing stations will generally depend on the appearance of the overall image or pattern to be printed on the web, for example if the image or pattern comprises four different colours or inks, it will normally be necessary for the printing apparatus to have four printing stations.

BRIEF DESCRIPTION OF THE DRAWINGS

FIG. 5 shows a perspective view of a punching or stamping device for producing labels or tickets, FIG. 6 shows a view of the FIG. 5 device in section taken along line VI—VI in FIG. 5, and, FIG. 7 shows a diagrammatic front view of a multi-station printing machine.

DESCRIPTION OF THE PREFERRED EMBODIMENTS

Figure 1:
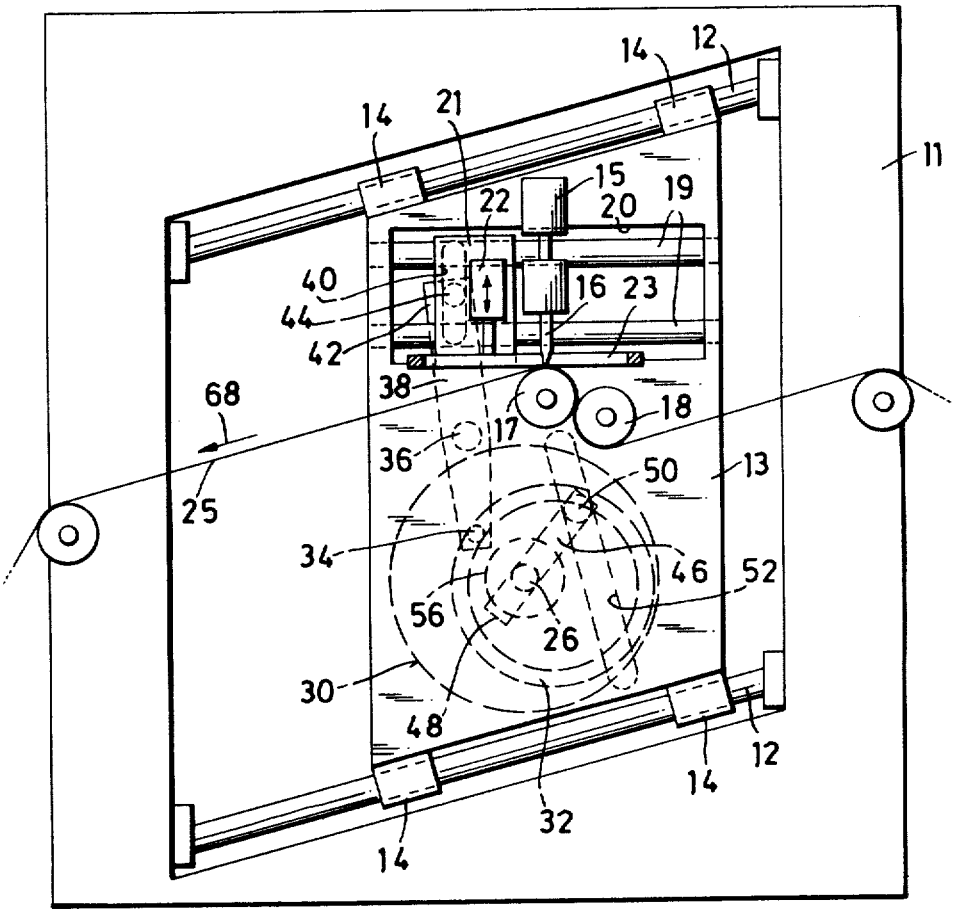
FIG. 1 shows a front view on to a printing station of a screen printing machine for printing material in web form.
Figure 2:
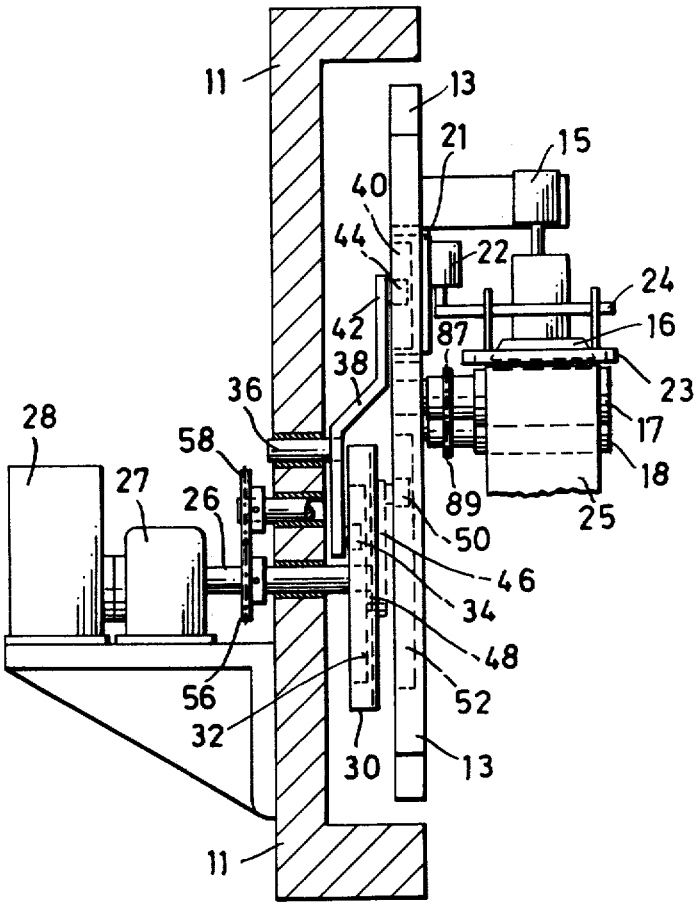
FIG. 2 shows a side view of the FIG. 1 printing mechanism.

Referring firstly to FIGS. 1 and 2, a screen printing machine has at least one printing station or mechanism which comprises a frame 11 to which two guide members or carriers 12 are secured, the two members 12 being disposed parallel to each other and in a vertical plane one above the other. The two members 12 extend at an angle of about 15° relative to the horizontal, as can be clearly seen from FIG. 1. However, other guide means may alternatively be provided instead of the two members 12, for example, two guide members one beside the other, or it is possible for the station to have only one such guide member, or possibly more than two such members.

The two members 12 serve as a guide and carrier means for a first main carriage 13 which is reciprocally movable along the members 12. The carriage 13 is slidably supported on the members 12 by lugs or bosses 14 or similar means, the lugs or bosses 14 embracing around the members 12. The carriage 13 also carries a fluid-operated piston-cylinder unit 15 which in turn carries a squeegee or doctor 16, hereinafter referred to as the doctor. The carriage 13 also carries two rollers 17 and 18, both of which are driven in rotation by means not shown.

The carriage 13 is provided with two horizontal guide members or carriers 19 which are disposed within a recess or opening 20 in the carriage 13. It will be appreciated that the members 19 may be replaced by other guide and carrier means, for example one, or more than two, such members, as described above with reference to the members 12. A second carriage 21 is reciprocably mounted on the two members 19. The carriage 21 also carries a fluid-operated piston-cylinder unit 22 which in turn carries a screen printing stencil 23 which is shown in the form of a flat stencil. The arrangement is of generally conventional kind, in that the stencil 23 is mounted for vertical adjustment on a stencil mounting member 24 (see FIG. 2). Actuation of the unit 22 will lower the stencil 23 for printing purposes, and lift it again after printing.

The roller 17 is disposed directly below the stencil 23, on the side thereof remote from the doctor 16, and forms a counter-pressure or backing roller for resisting the pressure applied to the stencil 23 by the doctor 16. Thus, during the printing operation, the stencil 23 fabric which is slightly resiliently deformable in the usual manner, is pressed by the doctor 16 against the top part of the roller 17 and thus against the web of material to be printed, indicated at 25 in FIG. 1, where the web 25 passes over the top of the roller 17. By virtue of the resilient deformability of the stencil 23 as mentioned above, it may be possible to omit the piston-cylinder unit 22 so that the downward movement of the stencil which is required in order to bring the stencil into contact with the web 25, and the movement of the stencil in the opposite direction, that is to say, upwardly again, may be produced solely by the downward movement of the doctor 16 which thus presses the stencil 23 into contact with the web 25 and against the roller 17, the upward return movement of the stencil 23 being produced by the resiliency of the stencil fabric when the pressure of the doctor 16 against the stencil 23 is removed.

The roller 18 which is disposed upstream of the roller 17 is a web guide roller to guide the web 25 correctly to and around the roller 17.

The printing mechanism is driven from a main drive shaft 26 which is itself driven by a motor 28 e.g. an electric motor or fluid motor by way of a transmission assembly 27 (see FIG. 2). Secured to the shaft 26 is a disc or wheel 30 which, at its side face which is towards the motor 28, provides a cam surface 32. A cam follower as indicated at 34, for example a roller, cam follower level or the like, co-operates with the cam surface 32. The cam follower 34 is mounted at one end of a double-armed lever 38 which is mounted in the frame 11 at pivot 36. At the end of its second arm 42 remote from the cam follower 34, the lever 38 carries a further follower 44, for example in the form of a roller, which engages into a vertical elongate opening 40 in the second carriage 21. Thus, pivotal movement of the lever 38 by the co-operation of the cam surface 32 and the cam follower 34 results in a reciprocating movement of the carriage 21 along the members 19. The configuration of the cam surface 32 is such that the carriage 21 and thus the stencil 23 carried thereby move at a constant speed during the printing operation, assuming that the speed at which the web 25 is moved is adapted to that of the stencil 23 during the printing movement of the assembly. The cam follower 44 at the second end 42 of the second arm of the lever 38 is mounted so as to be adjustable on the second arm, for the purposes of adapting the assembly to different lengths of image or pattern to be printed on the web 25. The stroke length and the speed of the carriage 21 and thus therewith the stencil 23, are increased, as the cam follower roller 44 is moved increasingly further away from the pivot 36. Increasing the length of the stroke movement of the lever 38 in this way results in an increase in the length of the image to be applied in one printing operation of the printing mechanism, as viewed in the longitudinal direction of the web 25.

The carriage 13 is driven in its reciprocating motion along members 12 by way of an adjustable crank link arm 46 which is pivoted to the wheel 30, at the side thereof opposite the cam surface 38, by means of pivot 48. At its free end the arm 46 carries a cam follower 50 such as a roller or the like, which engages into an elongate opening 52 in the carriage 13. As seen in FIG. 1, the slot 52 extends normal to the members 12 and thus normal to the line of movement of the carriage 13 as it reciprocates along the members 12. It will be appreciated that the effective length of the arm 46, between its pivot 48 and the cam follower 50, is adjustable, by corresponding adjustment of the pivot 48 on the wheel 30.

Figure 3:
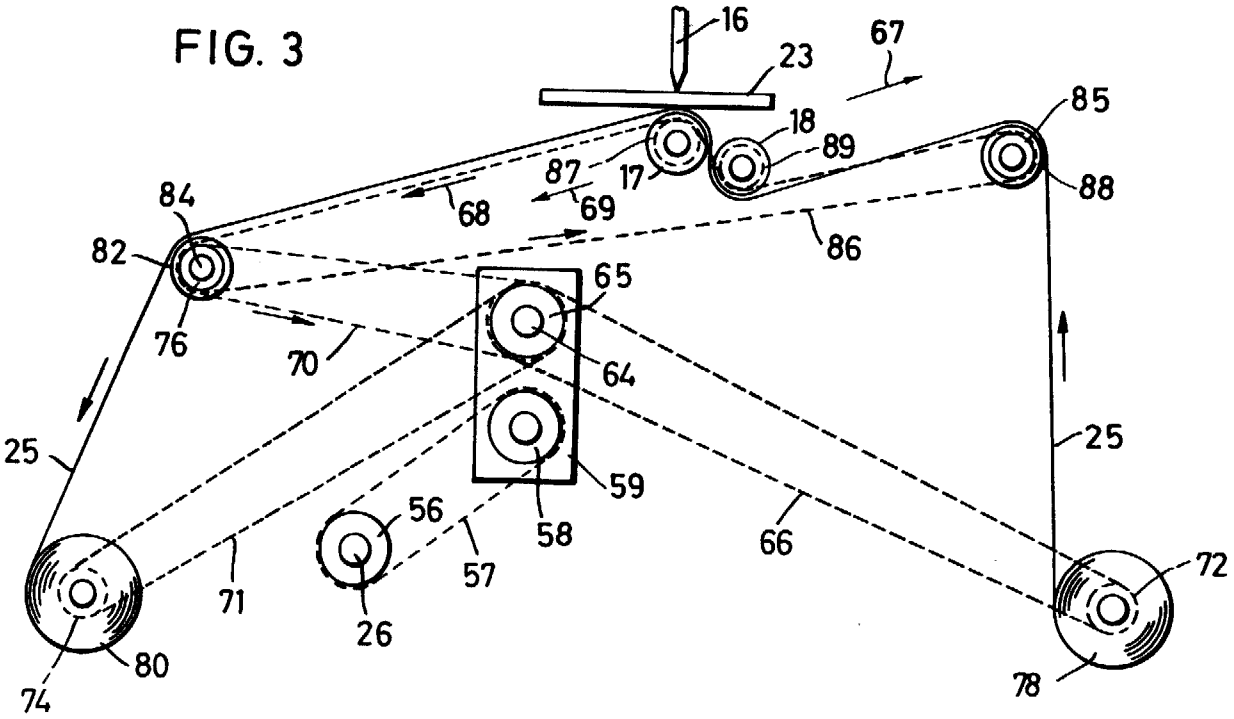
FIG. 3 shows a diagrammatic view of transmission means for transmitting the drive for the FIG. 1 printing mechanism and the web.

Also secured to the drive shaft 26 is a gear wheel 56 connected by a flexible elongate transmission member such as a chain 57 (see FIG. 3) to a drive or input gear 58 of a variable transmission assembly 59. Referring now also to FIG. 3, output shaft 64 of the assembly 59 is connected by way of a gear 65 on shaft 64, transmission members such as chains or the like, as at 66, 70 and 71 and co-operating gears 72, 76 and 74 respectively, firstly to a supply roll 72 from which the web 25 is wound off, secondly to a takeup roll 80 on to which the printed web 25 is wound after the printing operation, and thirdly to a drive roller 82 by means of which the web 25 is drawn properly from the printing mechanism. A further gear (not referenced) is fixedly mounted on the shaft 84 on which the roller 82 and the gear 76 are secured. This further gear is connected by way of a flexible transmission member such as chain 86 to gears 85, 87 and 89. The gears 87 and 89 are fixedly connected to the shafts which carry the counter-pressure roller 17 and the web guide roller 18 respectively. The gear 85 is fixedly connected to a shaft which carries a drive roller 88, so that the chain 86 drives the drive roller 88, the counter-pressure roller 17 and the guide roller 18. It will be seen that relative reciprocating movement of the two rollers 17 and 18 in the directions indicated by arrows 67 and 69 respectively will necessarily result in the peripheral speed of these two rollers 17 and 18 being adapted to the relative speed at which the web 25 moves over the surfaces of the two rollers 17 and 18, when the rollers 17 and 18 are reciprocated. Normally the arrangement will be such that a slipping clutch (not shown) is arranged between the respective gear wheels 72 and 74 and each of the two rolls 78 and 80, as variations in the peripheral speeds of rollers 78 and 80, such variations occurring in the course of the operation of winding on or winding off the web 25, will make it impossible for the web to be adjusted to its desired speed by the drive means associated with the two rolls 78 and 80. The speed of the web 25 between the two rolls 78 and 80, which must be adapted to the speed at which the stencil 25 moves during the printing movement of the stencil, is determined by means of the rollers 17, 18, 82 and 88.

It will be noted that the chain 86 is parallel to the web 25 at least in its portion adjacent arrow 68, which moves in the same direction as the web 25. It will also be seen that the portion of web 25 passing on to the roller 17 and the portion of web leaving the roller 17 are parallel to each other and at an acute angle such as 15° to the horizontal stencil 23.

FIGS. 1 and 2 do not show the drive and transmission means of FIG. 3, except for the gear wheels 56 and 58, for the sake of clarity of FIGS. 1 and 2.

FIGS. 4*a* through 4*f* show the successive stages in a printing operation, during a working cycle of the machine. FIGS. 4*a* through 4*f* only show the components which are part of the actual printing mechanism, that is to say, stencil 23, doctor 16, counter-pressure roller 17 and guide roller 18, as well as carriage 13 and the material 25 to be printed. FIGS. 4*a* through 4*f* show equally spaced reference lines A–D, in association with the printing mechanism, whose purpose is to indicate the extent of the movement of the various components of the printing mechanism, that is to say, carriage 13 with doctor 16 and rollers 17 and 18 on the one hand, and stencil 23 on the other hand. The path of movement over which the counter-pressure roller 17 moves is indicated by the associated reference scale 63, in order to show clearly the manner in which the web 25 moves during the printing operation.

Figures 4A, 4B, 4C:
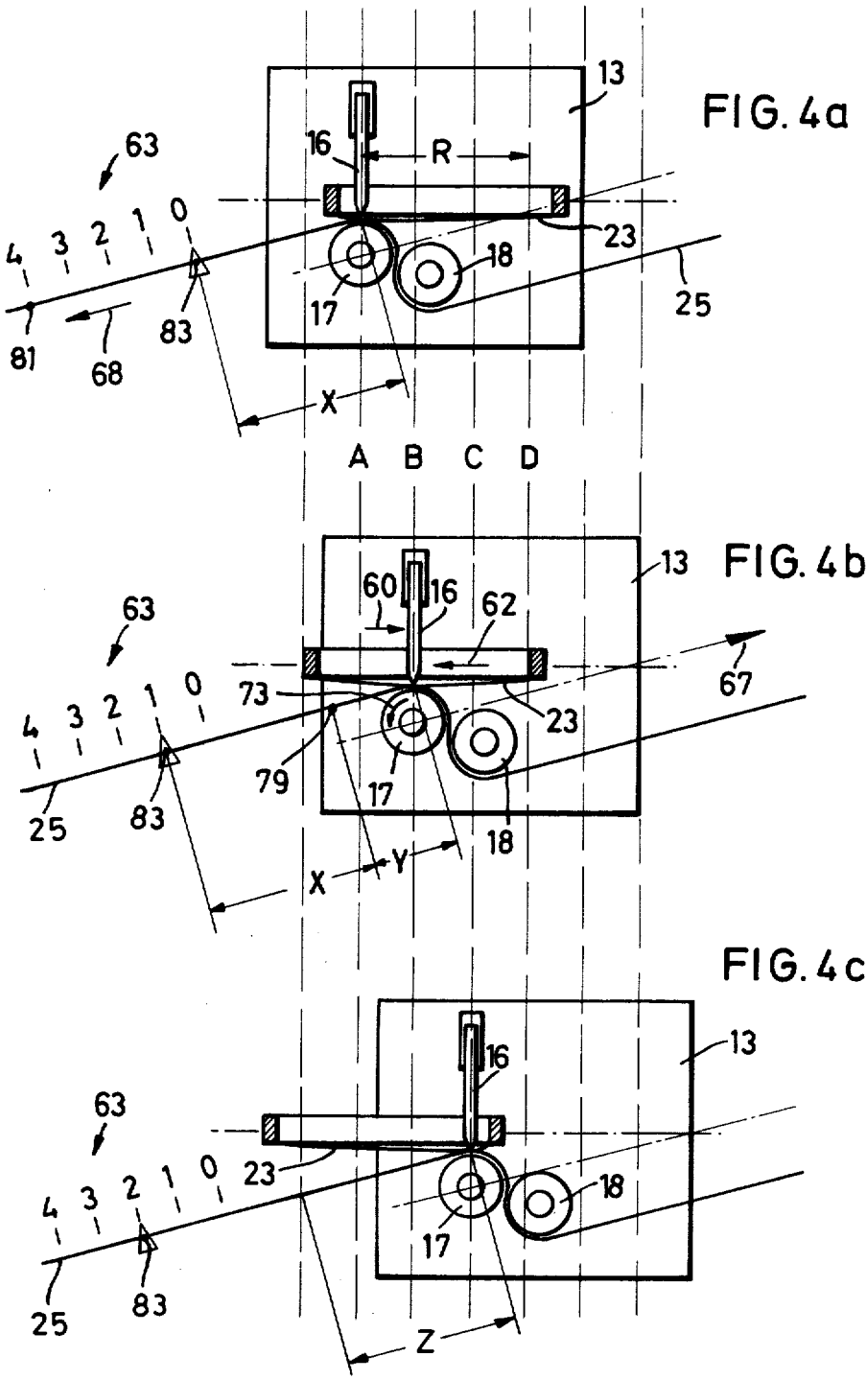
FIGS. 4*a* through 4*f* show successive stages in an operating cycle of the printing mechanism.

For the sole purposes of the following description of FIGS. 4*a* through 4*f*, it is assumed that the images to be printed on the web 25 are to be disposed thereon without any spacing between each two consecutive images. FIG. 4*a* shows the position of the printing mechanism components at the beginning of an operating cycle. The stencil 23 and the doctor 16 are in a lowered position so that the stencil 23 lies against the web 25 which extends partly around the periphery of the roller 17, the contact between stencil 23 and web 25 thus being in the region of the highest point (as shown in FIG. 4*a*) of the roller 17. Furthermore, the doctor 16 has been displaced downwardly (by unit 22, FIG. 1) in such a way that it has deformed the stencil 23 in a downward direction until the stencil also lies against the web 25. The carriage 13 with doctor 16 and rollers 17 and 18 is in a left-hand limit position. In the course of the subsequent printing stroke movement, the carriage 13 is moved rightwards as indicated by arrow 67 (FIG. 4*b*), and the stencil 23 is simultaneously moved leftwards as indicated by arrow 62 (also FIG. 4*b*).

The length of an image to be printed on the web 25, as viewed in the longitudinal direction of the web or in the direction of its movement through the printing mechanism, is to correspond to the length of the scale 63 (0–4). The limits or ends of the image which was provided in the next-but-one operating cycle before that which will begin with the position shown in FIG. 4*a*, are denoted by points 81 and 83. The image which was produced in the operating cycle directly preceding that which will begin with the position in FIG. 4*a* lies between point 83 and the highest point of the counter-pressure roller 17, and thus corresponds to the distance X in FIG. 4*a*.

In the course of the printing movement, the doctor 16 with the rollers 17 and 18 on the one hand, and the stencil 23 on the other hand, are moved in opposite directions, as indicated by arrows 60 and 62 in FIG. 4*b*, and the part of the web 25 around the roller 17 is rolled against the stencil 23. Because of these relative opposed movements of the components of the printing mechanism, with the web 25 also moving with the stencil 23 in the opposite direction to the doctor 16 and rollers 17 and 18 the doctor 16 and the stencil 23 are moved relatively to each other over a distance R which corresponds to the image length X or the distance 0–4 on the scale 63, before the web 25 has been fed forwardly by approximately half the length of the image to be printed. This can be clearly seen from a comparison between FIGS. 4*a* and 4*b*. In the course of the first phase of the printing operation, the doctor 16 and the roller 17 have moved from starting line A of FIG. 4*a* to an intermediate line B in FIG. 4*b*, in the opposite direction to the direction of movement 68 (FIG. 4*a*) of the web 25. At the same time, the stencil 23 is moved in the opposite direction (leftwards in FIG. 4*a*) by a distance which corresponds to about half its total length of movement. As a result, the longitudinally extending portion Y of web 25, which is printed in this working phase and which lies between the point 79 which was disposed at the highest point of the roller 17 in the starting position shown in FIG. 4*a*, and the point on the web 25 which now lies at the highest point of the roller 17 in the FIG. 4*b* position, is longer than the distance by which the web 25 was moved forwardly in the direction indicated by arrow 68, during this working phase. This can be seen from the distance covered by point 83 on the web 25, as indicated by the triangular marking, from the FIG. 4*a* position to the FIG. 4*b* position. It will be appreciated that this mode of operation is based on the fact that, because the roller 17, together with the doctor 16 and the roller 18, moves in the opposite direction to the movement 68 of the web 25, the stencil 23 moves in the direction 68 only over a distance which is less than the length of the image to be printed; this therefore makes it possible for the image to be applied to the web 25 in its longitudinal direction, at a speed greater than the speed at which the web 25 is moved continuously in the direction arrow 68. The length of the portion Y which is printed during about the first half of the printing stroke movement of the printing mechanism is approximately twice the length of the section 0–1 on the scale 63, the section 0–1 being the distance by which the web 25 has been fed forward through the printing mechanism in the same period of time.

FIG. 4*c* shows the position of the mechanism at the end of the printing stroke movement; the doctor 16 and the stencil 23 have each been advanced further in their respective directions of movement by about a distance which corresponds to the distance between the positions shown in FIG. 4*a* and 4*b*. The doctor 16 and thus also the roller 17, which rotates during the printing movement in the direction indicated by arrow 73 in FIG. 4*b*, are positioned at line C in FIG. 4*c*, and the stencil 23 has assumed its left-hand limit position. The length of web 25 which is printed during this movement is indicated by Z and corresponds to distance 0–4 on scale 63. In contrast, during this whole printing stroke movement, the web 25 has been moved forward in the direction 68 in FIG. 4*a*, only by a distance such that the point 83 (indicated by the triangular marking) is now located at marking 2 on the scale 63.

Figures 4D, 4E, 4F:
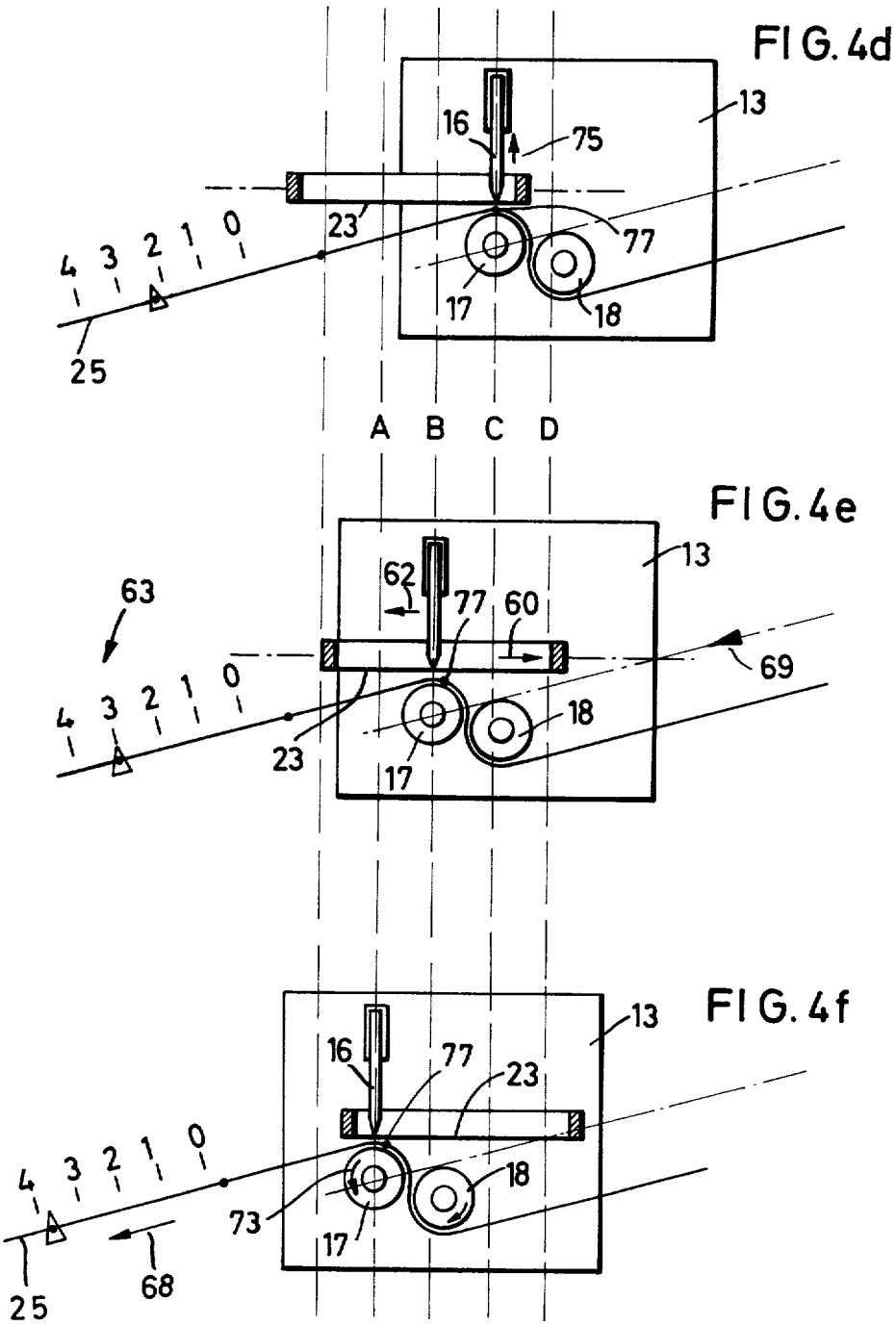

FIG. 4*d* shows the mechanism in a position corresponding to FIG. 4*c*, except that the doctor 16 and the stencil 23 have been lifted up away from the web 25, in the direction indicated by arrow 75 in FIG. 4*b* (actuation of unit 22 in FIG. 1). Now, the carriage 13 is returned by movement in the direction indicated by arrow 69 in FIG. 4*e*. At the same time, there is a return movement of the stencil 23, relative to the carriage 13. FIG. 4*e* shows an intermediate position in the course of these movements of the components of the printing mechanism. The speed at which the carriage 13 is moved back to its starting position in the direction indicated by arrow 69 is greater than the speed of the web 25, when the images printed on the web do not have any spacing therebetween. This difference in speed results in the doctor 16 and the roller 17 overtaking the web 25 so that, when the components have reached the position shown in FIG. 4*f* at the end of the return movements, the trailing end of the image which was previously applied (FIGS. 4*a* through 4*c*) and which is indicated by point 77 in FIGS. 4*d* through 4*f* is at a position which is just shortly upstream of the highest point of the roller 17. The period of time which is required for the web 25 to be moved further forward so that the point 77 on the web 25 is at the highest point of the roller 17, directly below the doctor 16, is utilised for the purposes of lowering the doctor 16 on to the stencil 23 an the stencil 23 on to the web 25.

The length and speed of the reciprocating movements which are performed by the two carriages 13 and 21 depend on the adjustment of the two cam followers 44 and 50 relative to the associated slots 40 and 52 in the respective carriages. The length of the reciprocating movements which are performed during the printing operation by the stencil 23 and the doctor 16 with its roller 17 determines the length of the associated overall stroke movement R (FIG. 4*a*) and thus the lengthwise dimension of the image to be printed. It follows from this that when the length of the image to be printed is changed, at least the length of the stroke movement of the stencil 23, i.e. of the carriage 21, must be accordingly adjusted, which in turn results in a change in the speed of the stencil during the printing operation. It will be seen that, as the web 25 is rolled against the stencil 23 during printing, the speed of the web must also be adjusted to coincide with the speed of the stencil 23. In addition, when there is a change in the length of the stroke movement of the stencil and thus the speed of the stencil during the printing operation, it is necessary for the speed at which the web 25 is moved in direction 68 to be altered accordingly. This is advantageously effected by corresponding adjustment of the variable transmission assembly 59 whose input drive wheel 58 is driven at a constant speed but whose output shaft 64 rotates at a speed determined by the respective selected setting of the assembly 59. Another possibility of adjustment in this manner is for the cam surface 32, or the wheel 30 which carries the cam surface 32, to be replaced by another cam surface or wheel, and thus for the drive conditions of the stencil 23 and possibly the doctor 16 with its roller 17 and guide roller 18, to be altered. It will be appreciated that both these possible means of adjustment may be used in combination.

The description given hereinbefore with reference to FIGS. 4*a* through 4*f* clearly shows the fundamental mode of the printing operation. It will be appreciated that modifications may be made with regard to the relative association between the individual movements, for example such that, at the end of the printing stroke movement, namely when the printing mechanism is in the position shown in FIG. 4*c*, the point 83 on the web 25 has not reached the marking 2 on the scale 63, or possibly has already passed beyond that marking. In the ultimate analysis, the determining factors are the periods of time required for the individual working steps and the speed at which the working steps are to be performed. Thus, it is possible for the method to be carried out in such a way that the consecutive images printed on the web of material overlap each other in their end regions. For this purpose it would only be necessary for the printing mechanism to be returned to its FIG. 4*f* position so rapidly or so early that the next printing operation begins before the end point 77 of the image printed in the preceding cycle has reached the highest point of the counter-pressure roller 17, directly below the doctor 16. It will be seen from this example that the printing method according to the invention is not only simple but is also of universal applicability and thus highly flexible.

This flexibility is particularly advantageous when the process according to the invention is to be used for printing labels or tickets. In this case referring to FIGS. 5 and 6, operation is generally such that a two-layer web 125 is printed on one side, in the manner described above. After the printing operation has been carried out, the individual tickets or labels are cut from the web by a cutting or punching operation. As shown in FIG. 5, the web 125 comprises two layers 193 and 194 which are secured together e.g. by adhesive. The upper layer 194 which carries the printing is cut or punched by means of suitable tools 190, 191, in the outline of the label or ticket 195. The labels or tickets 195 cut out in this way remain adhering to the other layer 193 which serves as a carrier. The labels or tickets 195 are subsequently removed from the carrier 193 in appropriate and conventional manner. The web portion 198 which remains after the labels or tickets 195 have been cut out and the two layers 193 and 194 have been separated from each other is taken away and discharged in suitable manner.

The individual tickets or labels 195 are cut out of the layer 194 by a punching or stamping blade 191 carried by a mounting 190. The configuration of the cutting edge 192 (FIG. 6) of the blade 191 corresponds to the desired configuration of the finished label or ticket. The blade 191 co-operates with a counter-pressure or backing roller 117 with which there is associated an upstream-disposed guide roller 118 (FIG. 6), in a similar arrangement to the printing mechanism described hereinbefore with reference to FIGS. 1 through 4. The rollers 117 and 118 are carried by a carriage (not shown) which corresponds to the carriage 13 of the printing mechanism described above with reference to FIGS. 1 through 4. The carriage carrying the rollers 117 and 118 is mounted in the same manner as the carriage 13, so as to be reciprocable at an angle to the horizontal which corresponds to the angle at which the web 125 leaves the roller 117. The blade 191 is carried by a carriage 121 (FIG. 6) which, in the same manner as the carriage 21 of the above-described printing mechanism of FIGS. 1 through 4, is mounted for horizontal movement on the carriage carrying the rollers 117 and 118; in other words, the mechanism shown in FIG. 5 is the same as the printing mechanism of FIGS. 1 through 4, in regard to the movements performed by the respective components of the mechanism. This also applies as regards the drive for the rollers 117 and 118, although it will be appreciated that the mechanism of FIGS. 5 and 6 will obviously not have components corresponding to the doctor 16 of the FIGS. 1 through 4 printing mechanism.

Figure 7:
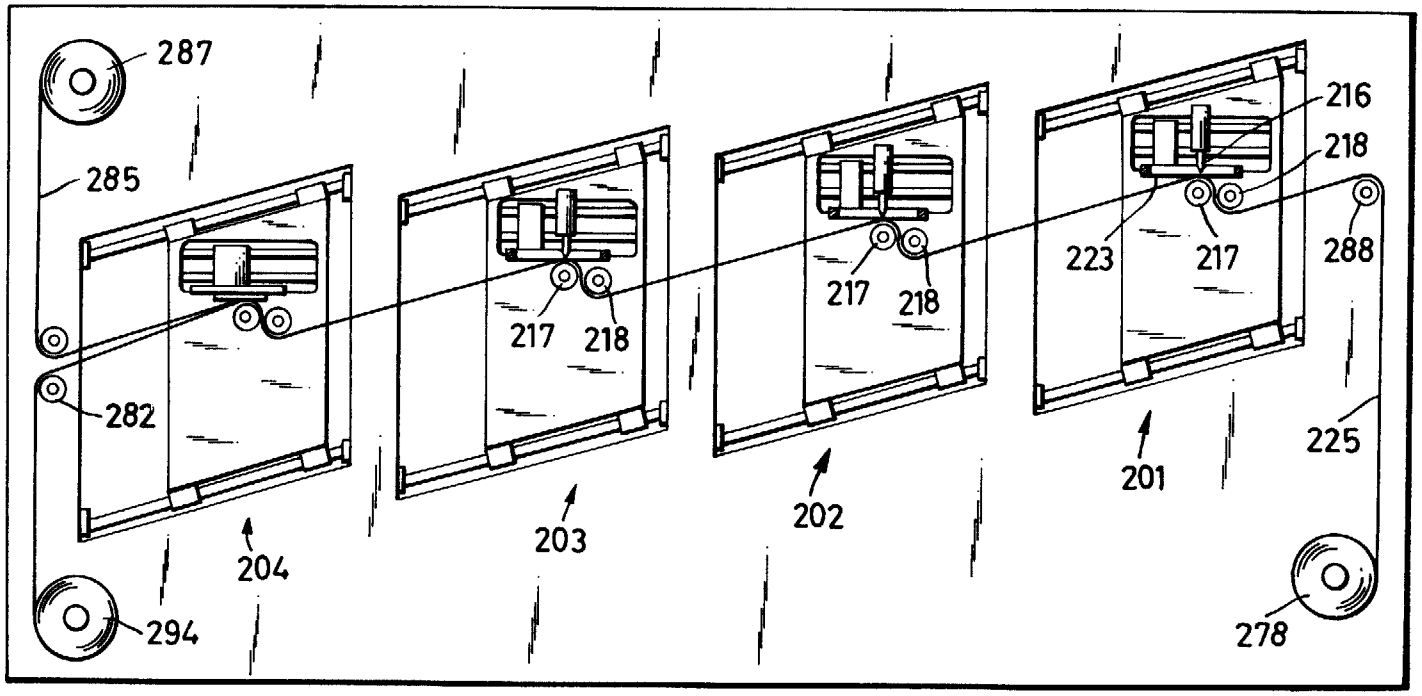

FIG. 7 shows a screen printing machine which has three printing stations 201, 202 and 203, and a station 204 in which labels or tickets are punched out, using a mechanism as shown in FIGS. 5 and 6. The web 225 to be printed is drawn from a supply roll 278 and passes through the three printing mechanisms 201 through 203 and thereafter through the severing station 204, in a continuous movement. When the web is a double-layer web or strip for printing labels or tickets, the carrier layer of the web 225 carrying the labels or tickets, is wound on to a receiving roll 294, after the operation of cutting out the labels or tickets. The web portion 285 which remains after the labels or tickets have been cut out from the printed layer is rolled on to a storage roll 287.

The printing machine shown in FIG. 7 makes it possible to apply three print media such as inks or dyes, and the individual printing stations are constructed in the manner described with reference to FIGS. 1 and 2. The individual components of all the printing stations, that is to say, more specifically, the doctor 216 with the counter-pressure roller 217 and the guide roller 218 on the one hand, and the screen printing stencil 223 on the other hand, can be moved synchronously with each other, although this may not be necessary. On the contrary, it is for example possible to carry out two printing stroke movements in one station, while in another printing station only one printing stroke movement is carried out in the same period of time; the sum of the length of the two printing stroke movements in said one station must be equal to the length of the one printing stroke movement in said other station. Other combinations of this kind are also possible. The speed of the web is the same in all the stations, and it will be appreciated that, in order to achieve a smooth mode of operation of the machine, it will generally be desirable as far as possible for all movable components to be operated synchronously with each other.

The counter-pressure rollers 217 and the guide rollers 218 of all the stations, the web guide rollers 282 and 288, and possibly other guide rollers (not shown) which may be disposed between the stations for web guide purposes, are advantageously driven by a common drive means in such a way that the flexible transmission member shown in FIG. 3 engages with all the gears or the like which are associated with the rollers in the printing stations and the cutting stations, and also with gears associated with the above-mentioned guide rolls between the respective stations. In this respect it should be noted that the flexible transmission member extends parallel to the web 225, as was described with reference to FIG. 3, over the lengths of the regions in which the counter-pressure rollers 217 and the guide rollers 218 of all the stations are moved. However, it is also possible for a separate flexible transmission member, similar to the member 86 in FIG. 3, to be associated with each station, although it will be appreciated that, for reasons of synchronisation, it will be more advantageous for a common drive motor to be provided for driving all the transmission members. Means such as for example heat radiators for drying the images or patterns applied to the web may be disposed downstream of the individual printing stations 201 through 203.

Although the foregoing description refers to material in web form, the material to be printed is not necessarily in a true web form, in the sense of a continuous strip of material to be printed, for example it is possible that the surface portions or items which are to be printed may be cut to size before the printing operation, or before the first printing operation where the method involves a plurality of printing operations, for example for producing labels, tickets, badges, stickers or the like. In such a case, the images or patterns to be printed are applied to the finished items which have already been cut to size and which are carried by a second continuous carrier layer, for example corresponding to the layer 193 in FIG. 5, in a manner similar to the operation shown in FIG. 5.

Thus the punching or cutting station shown in FIG. 5 could be disposed upstream of the printing station or the first printing station, in which case the web of material to be printed is in the form of a carrier web to which the individual portions to be printed are secured, as by adhesive.

Various modifications may be made in the process and apparatus according to the invention, without departing from the spirit and scope of the invention, in particular regarding equivalence of components or arrangements producing substantially the same results as indicated hereinbefore. For example, in a modified form of the FIGS. 1 and 2 embodiment, the carriage 21 for stencil 23 may be disposed on guide members or carriers mounted on the machine frame, instead of being disposed on the carriers 19. With such an arrangement, the carriage 21 is mounted independently of the carriage 13. The reciprocating motion of the carriage 21 in this modified embodiment is desirably parallel to the motion of carriage 13, so the carriers for carriage 21 extend parallel to the carriers 12 for carriage 13. In such a case, the stencil 23 must be capable of vertical movement relative to its carriage 21, in order for the stencil 23 to be moved to the correct position relative to backing roller 17, depending on the movement of carriage 13 and components 16, 17 and 18 carried thereby. The required vertical movement of the stencil 23 may be produced by a positive guide and actuation assembly comprising for example a horizontal guide member mounted on carriage 13 (or on stencil 23), and a cam roller or the like which is mounted on stencil 23 (or on carriage 13 respectively) and which engages with the guide member. When the carriage 13 is reciprocated, co-operation of the guide member and the cam roller will move the stencil 23 vertically for proper co-operation with roller 17. Such an arrangement provides that, even when the two carriages 13 and 21 move in opposite directions to each other, stencil 23, doctor 16 and backing roller 17 always assume their correct relative positions, by virtue of the positive interconnection between the respective carriage movements. It will however be appreciated that, if carriages 13 and 21 are in fact arranged to move in opposite directions, as just mentioned, then the carriers of one carriage will be inclined downwardly towards one end, while the carriers for the other carriage will be inclined upwardly towards their corresponding adjacent end, to provide the desired co-ordination of movement between the stencil and the backing roller.

It will be appreciated that the above-described modification may also be employed in other embodiments of the invention, and is given only as one example of possible modifications which may be made without departing from the spirit of the invention.

What is claimed is:

1. In a screen printing process for the stepwise printing of a succession of images on a longitudinally moving material by means of a printing mechanism comprising a printing stencil, an associated doctor adjacent one surface of said stencil, and a counter-pressure backing roller adjacent the other surface of said stencil opposite said one surface of said stencil, wherein the material to be printed upon is passed between said stencil and said backing roller so as to extend part way around said roller, wherein said stencil is moved downwardly onto said material for printing thereon and during said printing is moved with said material from a starting position to a final position relative to said doctor, the doctor pressing print medium through said stencil onto said material during said movement and said material being rolled against said stencil by said backing roller during said movement, wherein said stencil and said doctor are lifted from said material and returned to their relative starting position after each printing operation, wherein said doctor and said backing roller are displaced synchronously with respect to said stencil and in the opposite direction to the direction of motion of said material issuing from said backing roller, and wherein said stencil is substantially horizontal;

the improvement wherein a portion of said material passing to said printing mechanism and a portion of said material issuing from said backing roller are moved parallel to each other and downwardly at an acute angle relative to said stencil, and wherein said printing mechanism is moved, at least during said printing, parallel to said portions of said material.

2. A process as set forth in claim 1 wherein said portions of said material are moved at an angle of substantially 15° relative to said stencil.

3. In a screen printing apparatus for the stepwise printing of a succession of images on a material, comprising:

a printing mechanism comprising a stencil, a doctor adjacent one surface of said stencil, and a counter-pressure backing roller adjacent the other surface of said stencil opposite said one surface of said stencil;

means for passing said material into and through said printing mechanism, between said stencil and said counter-pressure backing roller so as to extend part way around said roller;

means for moving said stencil downwardly onto said material for printing on said material, and means for moving said stencil along with said material during said printing, from a starting position to a final position with respect to said doctor, the doctor pressing printing medium through said stencil onto said material, and said backing roller rolling said material against said other surface of said stencil during said printing;

means for lifting said stencil and said doctor from said material and returning them to their starting position after said printing;

means for displacing said doctor and said backing roller synchronously with respect to said stencil and in the opposite direction to the direction of moving of said material issuing from said backing roller, said stencil being substantially horizontal;

the improvement comprising means for guiding a portion of said material passing into said printing mechanism and a portion thereof issuing from said backing roller so that they move parallel to each other and downwardly at an acute angle relative to said stencil, said apparatus comprising means for moving said printing mechanism in a direction parallel to said portions of said material at least during said printing.

4. Apparatus as set forth in claim 3 including means for adjusting the distance by which said doctor and said backing roller are displaced with respect to the stencil.

5. Apparatus as set forth in claim 4 and further including a material guide roll disposed upstream of said backing roller and movable with said doctor and said backing roller within the adjusted limits of their movement.

6. Apparatus as set forth in claim 3 including means for adjusting the distance between said starting and final positions of said stencil.

7. Apparatus as set forth in claim 3 including means for rotating said backing roller at a speed dependent on the speed at which said backing roller is displaceable relative to said material.

8. Apparatus as set forth in claim 3, said printing mechanism further including a material guide roller disposed upstream of said backing roller, said backing roller and said guide roller being so disposed that the portion of said material which issues from said backing roller and the portion of said material which passes to said guide roller are offset relative to each other but parallel to each other and are at an acute angle to the horizontal.

9. Apparatus as set forth in claim 3 including an adjustable drive transmission means for moving said material.

10. Apparatus as set forth in claim 3, comprising common mounting means carrying said doctor and said backing roller.

11. Apparatus as set forth in claim 10 wherein said common mounting means is a first carriage.

12. Apparatus as set forth in claim 10 and further including a material guide roller disposed upstream of said backing roller and also carried by said common mounting means.

13. Apparatus as set forth in claim 10 including guide means for displaceably mounting said mounting means and extending parallel to said portions of material.

14. Apparatus as set forth in claim 13 and further including: a second mounting means for carrying said stencil; and second guide means disposed on said common mounting means and supporting said second mounting means for reciprocating movement on said common mounting means, said second guide means extending parallel to the plane of said stencil.

15. Apparatus as set forth in claim 14 wherein said second mounting means is a carriage.

16. Apparatus as set forth in claim 14 wherein said common mounting means forms an opening and said second guide means is arranged within said opening.

17. Apparatus as set forth in claim 14 wherein said second mounting means forms an elongate opening which extends normal to said second guide means, and further including means for driving said second mounting means, comprising: a pivotally mounted lever having first and second arms, a drive member mounted on the first arm of the lever at a position spaced from its pivot mounting, a cam follower mounted on the second arm of a lever at a position spaced from its pivot mounting, and cam means with which said cam follower co-operates and whose configuration determines the desired movement to be imparted to said stencil.

18. Apparatus as set forth in claim 17 wherein said cam means is a cam surface provided on a rotary member.

19. Apparatus as set forth in claim 17 wherein said means for driving said second mounting means includes an adjustable means for varying the driving of said second mounting means.

20. Apparatus as set forth in claim 17 wherein said means for driving said second mounting means includes an interchangeable means for varying the driving of said second mounting means.

21. Apparatus as set forth in claim 13 wherein said common mounting means forms an opening which extends normal to said guide means, and further including means for driving said common mounting means, including a drive member and transmission means connecting said drive member to said common mounting means.

22. Apparatus as set forth in claim 21 wherein said drive member comprises a crank arm.

23. Apparatus as set forth in claim 22 wherein said second mounting means forms an elongate opening which extends normal to said second guide means, and further including means for driving said second mounting means, comprising: a pivotally mounted lever having first and second arms, a drive member mounted on the first arm of the lever at a position spaced from its pivot mounting, a cam follower mounted on the second arm of a lever at a position spaced from its pivot mounting, and a rotary member comprising cam means with which said cam follower co-operates and whose configuration determines the desired movement to be imparted to said stencil, wherein said crank arm is mounted rotatably and adjustably on said rotary member.

24. Apparatus as set forth in claim 19 wherein said means for driving said common mounting means includes an adjustable means for varying the driving of said common mounting means.

25. Apparatus as set forth in claim 21 wherein said means for driving said common mounting means includes an interchangeable means for varying the driving of said common mounting means.

26. Apparatus as set forth in claim 3 and further including a material guide roller disposed upstream of said backing roller, and means for rotating said guide roller at a speed dependent on the speed at which said guide roller is displaceable relative to said material.

27. Apparatus as set forth in claim 26 including at least first and second drive guide rollers for said material, which drive guide rollers are each arranged at a spacing from the assembly of said doctor, backing roller and stencil and which each have a drive shaft, and further including respective drive wheels on each of said shafts and a common flexible elongate drive means drivingly interconnecting all said drive wheels, the flexible drive means having a portion which extends along a region which is parallel to the path of movement of said material and in which said flexible drive means moves in the opposite direction to the movement of said material.

28. Apparatus as set forth in claim 27 wherein said flexible drive means comprises a chain and said drive wheels are gears.

* * * * *